United States Patent [19]

Staples

[11] 4,022,408

[45] May 10, 1977

[54] TRACK CIRCUITS WITH CAB SIGNALS FOR DUAL GAGE RAILROADS

[75] Inventor: Crawford E. Staples, Edgewood, Pa.

[73] Assignee: Westinghouse Air Brake Company, Swissvale, Pa.

[22] Filed: Mar. 3, 1976

[21] Appl. No.: 663,516

[52] U.S. Cl. ..... 246/34 R; 246/37; 246/40; 246/57; 246/75

[51] Int. Cl.[2] ..... B61L 21/06

[58] Field of Search ..... 246/34 R, 34 CT, 35–37, 246/40, 57, 75, 121, 128, 130; 324/37, 39

[56] References Cited

UNITED STATES PATENTS 2,806,943 9/1957 Cremer et al. ..... 246/37

FOREIGN PATENTS OR APPLICATIONS 1,301,400 7/1962 France ..... 246/37

*Primary Examiner*—Stephen G. Kunin

*Attorney, Agent, or Firm*—A. G. Williamson, Jr.; R. W. McIntire, Jr.

[57] ABSTRACT

Alternating current track circuit energy for train detection and cab signals is coupled to the exit end of an insulated, dual gage track section between the common rail and the other two rails connected in parallel. The track relay is connected at the entrance end in a similar manner. Impedance bonds for direct current propulsion are also connected between the common rail and the other two rails at each end. In all forms, the propulsion return current is sufficiently balanced between the three rails to eliminate cab signal interference in either gage. In a first arrangement, a direct wire connection multiples the two other rails at each end. Impedance bond taps to complete the return circuit provide a two to one turn ratio from the common rail end of the bond winding to equalize the propulsion current ampere turns on each side of the tap and thus balance the flux generated. In a second form, the short end of the impedance bond has two windings with an equal number of turns but each only one-half of the larger end turns. Each short end is connected to one of the other rails to again balance the total ampere turns on each side of the winding tap. In a third form, the other rails are coupled at each end of the section by an L-C circuit path with track circuit energy and the track relay connected between the common rail and the junction between the L and C elements. A center tapped impedance bond is connected in a conventional manner between the common and narrow gage rails at each end with a resistive impedance path connected between the tap and the broad gage rail.

17 Claims, 6 Drawing Figures

TRACK CIRCUITS WITH CAB SIGNALS FOR DUAL GAGE RAILROADS

BACKGROUND OF THE INVENTION

My invention pertains to track circuits with cab signals for a dual gage railroad. More particularly, the invention relates to a track circuit arrangement for an electrified, dual gage, common rail railroad track, which will provide train detection, broken rail warning, and cab signal energy for trains of either gage.

When a proposal was made to provide continuous cab signals to all trains using a stretch of dual gage railroad, several problems had to be solved. The fact that the trains of each gage using the track are electrically propelled by direct current energy created a first problem in that the cab signal track circuits had to provide a return circuit path for the prupulsion energy. While solutions were known in conventional railroading, these arrangements had to be incorporated into the overall duel gage surroundings or situation. Track circuits which would assuredly detect trains of either gage moving over a section of track were obviously a necessity from a safety standpoint. Correlated is the desirability of detecting and warning the trains of broken rails. Finally, cab signal energy must be supplied to each train of either gage at a sufficient level to operate the train carried, cab signaling apparatus. All these problems have to be solved together to achieve a complete and operable system having sufficient safety and efficiency to warrant installation.

Accordingly, an object of my invention is a cab signal control system for a dual gage stretch of railroad track.

Another object of the invention is a track circuit arrangement for an electrified, dual gage railroad track which also controls continuous cab signal apparatus onboard the trains.

A further object of my invention is a cab signal and track circuit system for an electric propulsion stretch of a dual gage railroad track.

It is also an object of the invention to provide, for a dual gage electrified stretch of railroad, a track circuit arrangement to detect trains, detect broken rails, and control cab signals.

Still another object of the invention is a track circuit, cab signaling system for an electrified dual gage stretch of railroad which provides train detection, broken rail detection, and control energy through the rails for train carried cab signal apparatus.

Other objects, features, and advantages of my invention will become apparent from the following specification when taken in connection with the accompanying drawings and appended claims.

SUMMARY OF THE INVENTION

The arrangement embodying my invention is applied to a dual gage stretch of railroad in which one rail is common to both gages and obviously a different other rail is provided for each gage. There is thus a total of three rails in the stretch of railroad, one of which is used by trains of either gage. This track is divided into insulated sections. Since electrical propulsion of the trains is involved, impedance bonds are required at each junction between sections on both sides of the insulated joints to provide a propulsion current return circuit. The bond winding is connected between the common rail and the other two rails of the stretch and is coupled to the other rails either directly, by multiple connections, or by other impedance elements in accordance with the requirements and characteristics of the track section. The basic arrangement connects the impedance bond winding between the common rail and the other two rails which are connected in multiple by direct wires at least at each end of the section. The propulsion return current connection between adjoining track sections is then made between off-center taps on the adjacent impedance bond windings. In a second arrangement, the first or principal bond winding is connected between the common rail and one of the gage rails. The other gage rail is then connected by a second winding on the impedance bond to the off-center tap of the first winding, both of which are wound on a common core. In each of these two arrangements, the ratio of turns in each portion of the windings is selected, in accordance with the balanced flow of propulsion current in each rail, so that the flux developed on both sides of the winding tap balances out. The second arrangement provides a better balance of the track section and more assured train and broken rail detection. In a third arrangement, the impedance bond winding is connected between the common rail and the narrow gage rail with a center tap of this winding connected through a resistance path to the broad gage rail and directly to the adjacent bond center tap. In this last arrangement, the two other rails are also coupled by a series inductor-capacitor network which is part of the track circuit arrangement and provides a phase shift required for the track relay operation.

The basic track circuit connections provide an alternating current energy source coupled to the rails at the exit end of the section through a track transformer. In the first arrangement, this track transformer coupling is connected between the common rail and the other two rails directly coupled in multiple. The track relay at the section entrance end is a two winding, vane type, alternating current relay which requires a phase shift between the track and local winding currents in order for the relay to operate. In the first arrangement, the track winding is connected across the common rail and the other two rails connected in multiple. The local winding, of course, is provided with a connection to the same alternating current source providing the energy for the track rails. In this arrangement, the impedance of the track rails and ballast provides the necessary phase shift which operates the relay. In the second arrangement, the track circuit energy source and the relay track winding are each connected between the common rail and the narrow gage rail, which in turn is coupled to the broad gage rail at each end by the impedance bond windings. In the last arrangement, the track relay and source are each coupled between the common rail and the junction between the series inductor and capacitor impedances which couple the other two rails in multiple. The track circuit energy source in each case may be so arranged that it provides coded energy for cab signal control when a train occupies a section. In one specific illustration, where broken rail detection is difficult in the two other rails due to the special characteristics of the track strength, a higher frequency (AUDIO) track circuit is applied to the track loop formed by the two other rails and the direct wire connections at each end of the section. This AF track circuit functions separately from the regular detector track circuit apparatus to provide broken rail detection in the two other rails.

BRIEF DESCRIPTION OF THE DRAWINGS

Before defining the novel features of my invention in the claims, I shall describe in more detail the several track circuit arrangements embodying the featues of my invention, with reference from time to time to the accompanying drawings in which:

Figure 1:
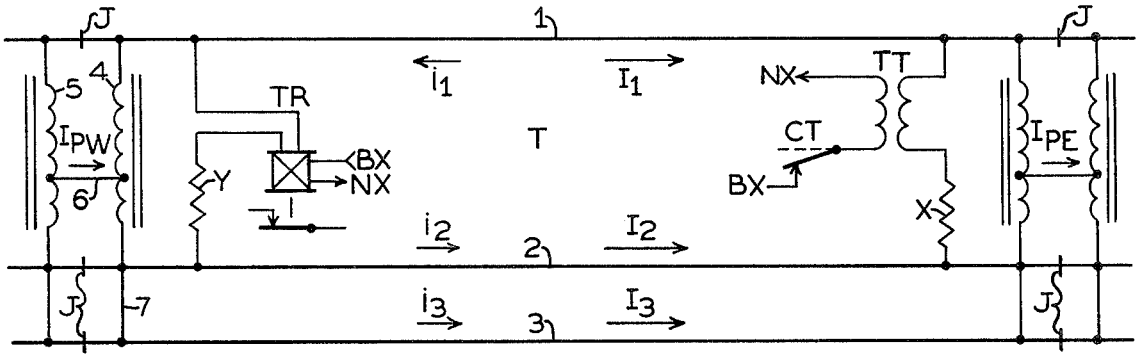
FIG. 1 is a schematic circuit diagram of a detector track circuit for a section of dual gage railroad which also supplies coded cab signal control energy to trains of either gage traversing the section.
Figure 4:
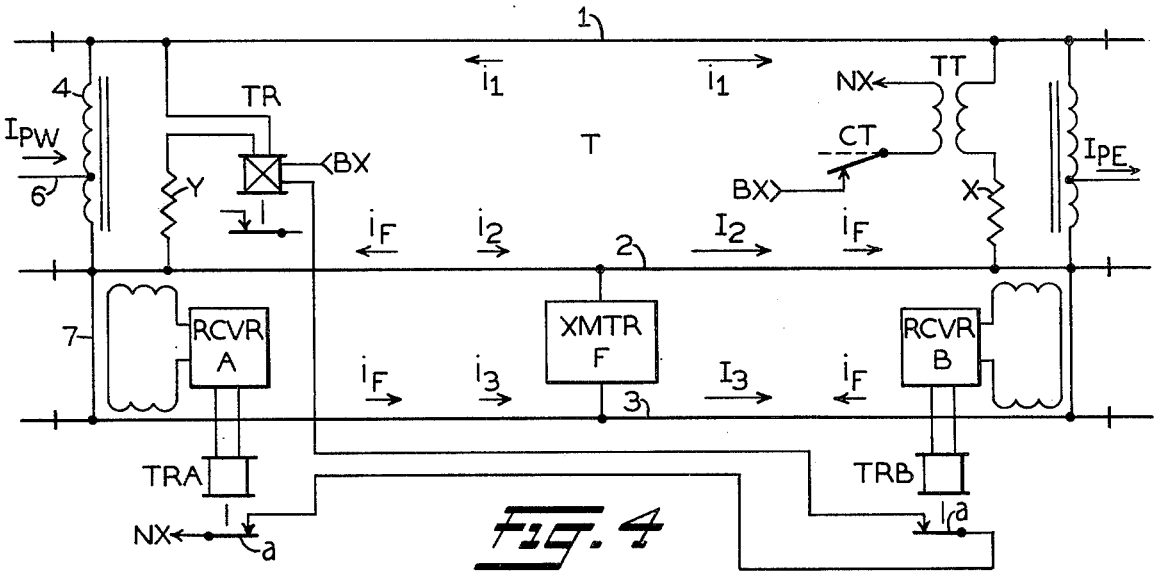

The diagram of FIG. 4 adds to the track circuit arrangement of FIG. 1 a supplemental track circuit to detect broken rails in the narrow and broad gage rails of the track section.

Figure 5:
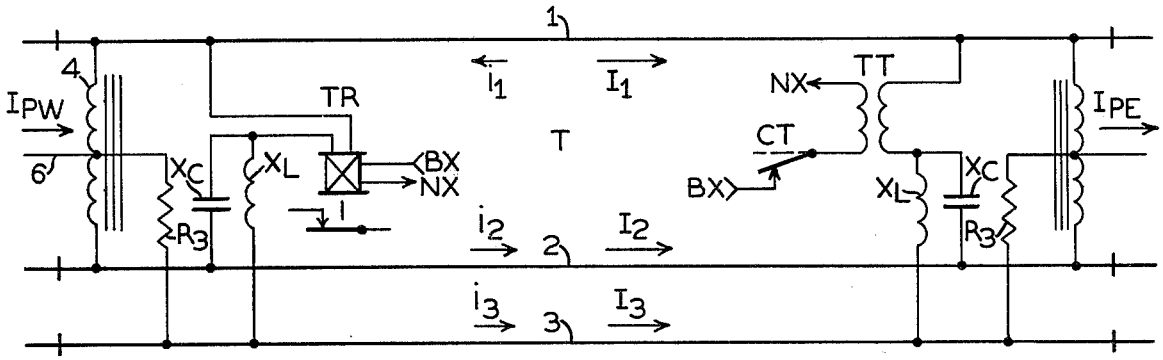

FIG. 5 is another schematic circuit diagram illustrating another modification of the track circuit arrangement embodying my invention.

Figure 6:
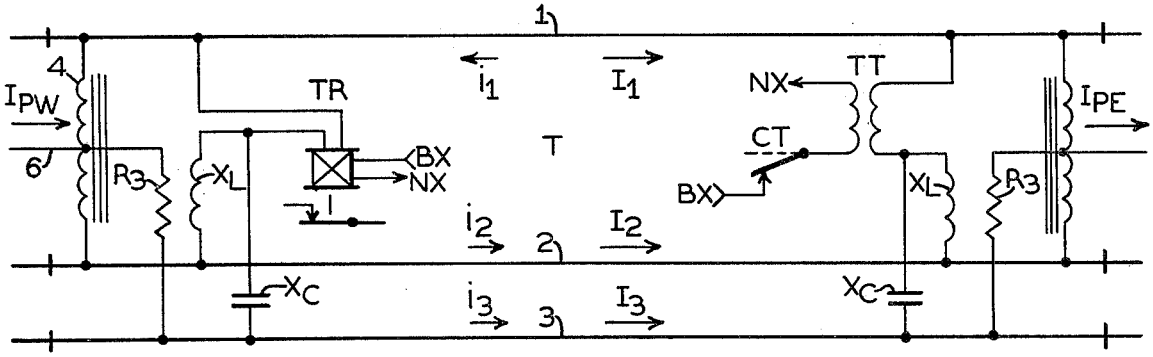

FIG. 6 is a track circuit diagram similar to that of FIG. 5 with the impedance coupling elements between the broad and narrow gage rails reversed in order.

In each of the drawing figures, similar reference characters designate the same or similar parts of the apparatus. In each of the track circuit arrangements, an alternating current energy source providing the track circuit current is designated by the terminals BX and NX. Wherever these terminals appear, they designate a connection to the corresponding terminal of the same alternating current energy source at each location. As a specification example, this alternating current source may have the conventional commercial frequency of 60 Hz.

DESCRIPTION OF THE ILLUSTRATED EMBODIMENTS

Referring now to FIG. 1, a stretch of dual gage railroad track is conventionally illustrated by the lines 1, 2, and 3. The reference 1 designates the rail common to both gages, while references 2 and 3 designate the other rail for the narrow and broad gage trains, respectively. By way of a specific example, in one installation the narrow and broad gage widths are 1.0m and 1.6m, respectively. The same dual gage track stretch is shown in each drawing figure with the same reference for the corresponding rails. Trains are assumed normally to move left to right in each of the drawing figures and the various track circuits are conditioned to supply coded cab signal energy only for trains moving in that direction. Obviously, such track circuits are here illustrated can be modified for either direction operation if desired, but for simplicity such arrangements are not herein shown as they are not necessary to an understanding of the principles of the inventive arrangements. The stretch of track is divided into track sections by insulated joints J. One such insulated joint J is required at each rail where the separation between sections is made and such joints are shown by conventional symbols so designated. Only one complete track section T is shown in each drawing figure set off by insulated joints shown by the same conventional symbol.

It is assumed that trains of either gage operating in this stretch of railroad are electricaly propelled, for example, by direct current energy. Thus the return path through the rails for the propulsion current must be completed around the insulated joints J by well known impedance bonds. There are two impedance bonds at each junction location between adjoining sections, one connected across the rails on each side of the insulated joint. Each impedance bond consists of a tapped winding on an iron core, with the taps on the associated pair of bonds for the adjoining sections connected together. Thus at the left end of section T, the winding 4 of an impedance bond is connected across the rails of section T while an equivalent impedance bond winding 5 is connected across the rails of the adjoining track section to the left. The taps on these impedance bond windings are connected by a direct wire lead 6. The return propulsion current flows through this connection 6 as illustrated by the arrow designated by the reference $I_{PW}$. In a conventional track circuit arrangement, the impedance bond taps are at the midpoint of each winding. It is to be noted here that the other rails 2 and 3 are connected in multiple by a direct wire lead 7 at this junction location with a similar direct connection between these rails a the other end of section T and on the opposite sides of the insulated joints in each of the adjoining sections. The propulsion return current $I_{PW}$ thus divides substantially equally between the three rails of this dual gage track, as indicated by the propulsion current arrows designated $I_1$, $I_2$, and $I_3$, respectively, for rails 1, 2, and 3 of section T. Therefore, to balance the ampere-turns in the impedance bond winding, the tap is at the two-thirds point from rail 1. In other words, as shown symbolically, there are two times as many winding turns in the upper portion of the inpedance bond winding 4 as below the tap location. Since twice as much current flows through the short portion of the winding to the rails 2 and 3 in multiple, the wire size for this short end of the winding must have twice the current carrying capacity as that of the longer end. Since with twice the current flowing through the short end of the impedance bond winding as through the long end, an equal number of ampere-turns exist on each side of the tap location which balances the flux developed in the impedance bond. In other words, a single unit of current flowing through the number of turns in the upper portion of winding 4 balances the two units of current flowing through half the number of turns in the lower portion of the winding.

The track circuit for train detection is supplied with alternating current energy at the exit end of the section from the alternating current source represented by the terminals BX and NX. The source is coupled to the rails through a track transformer TT with a contact CT included in the connections to the primary winding. This contact CT represents the code following contact of a code transmitter which may be approach controlled, that is, energized when a train enters the track section. Such code transmitters are well known in the railway signaling art and, when energized, periodically operate their contacts between picked-up and released positions at a predetermined code rate or frequency. Since this device is here assumed to be approach controlled, the armature of contact CT is shown solid in its released position and dotted in the picked-up position to indicate such periodic coding under selected conditions. In other words, coded track energy is supplied to control cab signals only when a train occupies the section. As long as the electric propulsion is direct current, the alternating current for tack circuit energy may be of any frequency and, as previously mentioned, is here assumed to be 60 Hz, the conventional commercial frequency.

The secondary of transformer TT is connected across rails 1 and 2 in series with a current limiting resistor X. Since rails 2 and 3 are permanently connected together in this arrangement, tansformer TT is actually connected between rail 1 and the parallel circuit through rails 2 and 3. One winding of the track relay TR is connected, in series with the resistor Y, across the rails at the entrance end of the section between rail 1 and the parallel path of rails 2 and 3. Although other styles of relays may be used, relay TR is here shown as an alternating current, vane type relay having a track winding connected across the rails and a local winding connected to the alternating current source deisgnated by terminals BX and NX. Such relays, well known in the railway signaling art, respond to energization of both windins only when a preselected phase differential exists between the currents flowing in the track and local windings. The source BX, NX to which the local winding is connected is the same source that is used for the track circuit energy at the exit end of the section and will normally be supplied to the various locations along the stretch of railroad track by a wayside line circuit.

With the track section unoccupied, the instantaneous track circuit current flowing in the rails is shown by the lower case letter $i$ and arrow symbol adjacent each rail. Obviously, the current flowing in rail 1, designated by $i_1$, is the full track circuit current ($i_s$) while the return current through rails 2 and 3 divides in what may be considered as substantially equal amounts. Actually, the mutual inductance between the rails produces a circulating current in the loop formed by rails 2 and 3 which may be about 5 percent of the total signaling current $i_s$ when the ballast is dry and becomes less as the ballast becomes wetter. Consequently, current $i_2$ is approximately 55 percent of the total track circuit current $i_s$ while $i_3$ is approximately 45 percent of $i_s$. Track relay TR is properly energized so that its front contacts are closed, as illustrated by the single contact shown below the relay winding, only when section T is unoccupied. If it is desired that the track current be normally coded, relay TR will be of a type which follows code and its contact will be periodically closed in the front position as code pulse are received. Resistors X and Y, which are part of the track circuit, and track transformer TT are adjusted as necessary in order to establish the proper phase relationship between the track or rail current and the local winding current so that relay TR will operate when the track section is unoccupied. If necessary, resistors X and Y may be replaced by impedances having more inductance than an ordinary resistor, in order to provide sufficient phase shift of the rail current for relay operation.

Figure 2:
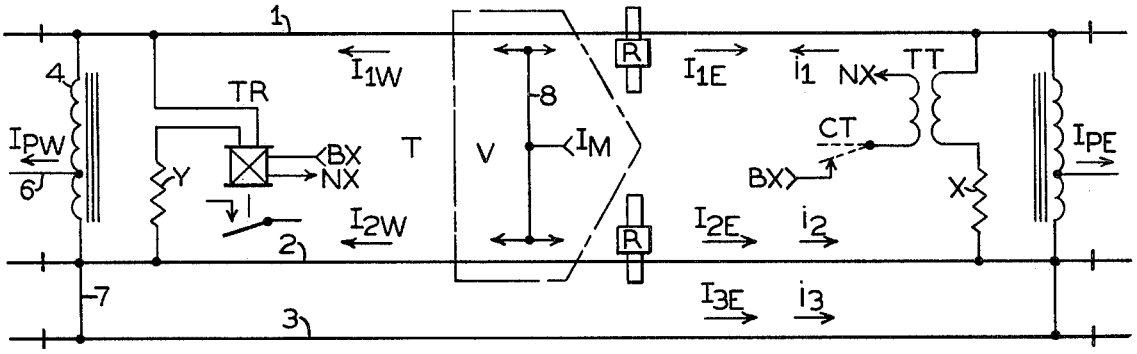
FIG. 2 is a schematic diagram illustrating the current flow conditions in the track circuit arrangement of FIG. 1 when a narrow gage train occupies the track section.

The connections of relay TR and the various track currents when a train current section T are shown in FIG. 2. It is assumed that the train is a narrow gage type indicated by the dot-dash block outline V. As the description progresses, the corresponding conditions which exist when a broad gage train occupies the section will become apparent. Only the impedance bond windings within section T and the connection from the winding tap to the tap of the associated bond in the adjoining section are shown in this and subsequent drawing figures. The symbol 8 within block V represents the propulsion energy flow $I_M$ from the catenary or third rail supply through the train motors, axles, and wheels to rails 1 and 2. The axle and wheel units of train V shunt the track circuit current from rail 1 to rail 2 so that insufficient current will flow through the track winding of relay TR to hold the relay operated. The track relay therefore releases, as indicated by its open contact position, to detect the presence of the train. However, when the train first enters the track section, the track circuit or cab signal current ahead of the train still divides between the rails relatively as in the unoccupied track section. In other words, the full track circuit current flows in rail 1 ahead of the train as indicated by the arrow $i_1$ and the current in rails 2 and 3, indicated by the corresponding arrows $i_2$ and $i_3$, divides approximately 55 and 45 percent, respectively. The block symbols designated R, immediately in front of train V as it moves to the right, represent the cab signal receives which inductively pick-up energy from the rails and then supply it so the train carried cab signal apparatus to result in cab signal indications for the train operator. It is to be noted that this is cooled energy, as indicated by contact CT shown dotted in each of its two positions, this action being initiated by an approach control arrangement when the train enters the section.

As the train approaches the exit end of the track circuit, the cab signal current increases since the shunt is closer and the percentage flowing in rail 2 for a narrow gage train increases while the current in the other rail 3 decreases. It has been found that, since the cab signal receivers on a train are centered from four to six inches inside of the rail gage, the rail current $i_3$ has only 10 to 12 percent the effect of the current $i_2$ on the narrow gage receivers, while current $i_2$ will have only about 30 percent the effect of $i_3$ on the wide gage receiver. Consequently, when the train first enters the track section, the combined effect of currents $i_2$ and $i_3$ is only about 60 percent of the effect of current $i_1$. Thus it is necessary to increase the entering cab signal current to about 125 percent of the normal which may be done in any known manner by approach control. As the train moves toward the exit and of the section, the cab signal rail current increases and the balance improves. In order to achieve the desired balances in track circuit current, it may be necessary in long track sections to add other cross connections similar to wire 7 at intermediate points between the ends of the track section.

The flow of propulsion current in the rails is indicated in the usual maner by the various arrows designated by the references I. However, exactly how the propulsion current divides between the rails when the section is occupied depends upon several factors which may include the actual current drawn by the particular train occupying the section, the feedthrough currents $I_{PW}$ and $I_{PE}$ drawn by other trains, the gage occupied, the track section length, the location of the train within the track section, and the location of cross bonding in return feeders. In general, the propulsion current will be nearly equal in the two running rails below the locomotive cab signal receiver coils R so that propulsion current interference with cab signal operation is minimized. It may be noted that the direction of the propulsion return current $I_{PW}$ in connection 6 to the impedance bond for the section to the rear of the train may be reversed in direction, as is specifically illustrated in FIG. 2. Under this condition, the current in rails 1 and 2 also flows in both directions from the location of the train itself. As the train approaches the exit end of the track section, the current $I_{1E}$ in rail decreases somewhat with respect to the current in the other running rail below the receiver of the cab signal. However, this unbalanced propulsion current in the running rails will not harm the impedance bond at the feed end of the track circuit and will not appreciably affect its impedance until the trail is almost ready to exit. Since the cab signaling current at this time is relatively high, operation of the cab signals will not then be adversely affected by the unbalance of the propulsion return current.

Figure 3:
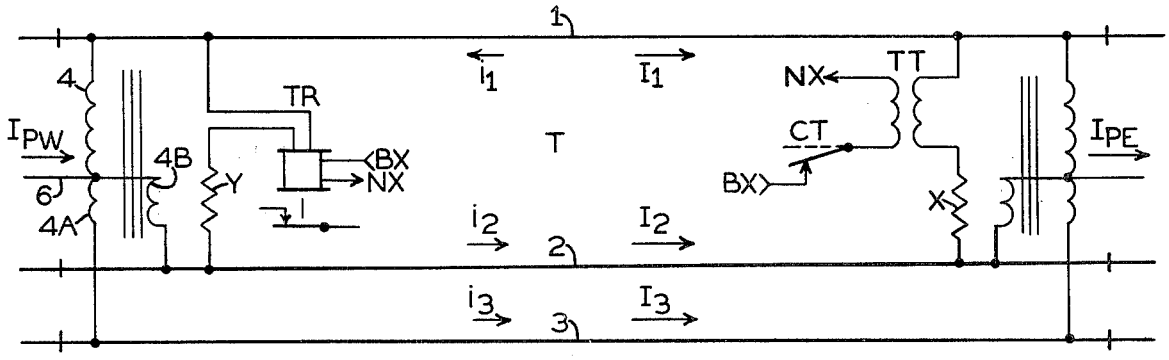
FIG. 3 is a similar circuit diagram of a first modification of the track circuit arrangement illustrated in FIG. 1.

Another arrangement which may provide better current balance and broken rail detection under certain track characteristics is shown in FIG. 3. There is no change in the track circuit connections within FIG. 3 but the impedance bonds and coupling between rails 2 and 3 differ. A second winding is added to the core of each impedance bond as shown at the entrance end of the section by the winding 4B. In this figure, the smaller portion of the original impedance bond winding is designated by the reference 4A with the larger portion retaining the original reference 4. The number of turns in the second winding 4B is equal to that in portion 4A and each is equal to one-half the number of turns in the larger portion 4 of the main winding. The same size wire is used in all windings in this arrangement. The one end of winding 4 is still connected to rail 1 but the other end joined with winding 4A is also connected to one end of winding 4B. The other end of winding 4A is connected to rail 3 while the other end of winding 4B is connected to rail 2. Rails 2 and 3 are thus coupled in a parallel circuit by the connection through windings 4A and 4B at each end of section T. Since the propulsion return current divides approximately equally between the three rails in the condition shown, the same number of ampere-turns is developed in winding 4, between the point at which lead 6 from the adjoining section connects to the tap on the impedance bond and rail 1, as the total number of ampere-turns developed in both windings 4A and 4B. Thus an equal number of ampere-turns exists on both sides of the tap on the impedance bond windings and the flux generated in each portion balances.

Broken rail detection may also be improved over that provided by the basic arrangement of FIG. 1 by the modification shown in FIG. 4. This arrangement retains the track circuit for train detection shown in FIG. 1 and adds a higher frequency, jointless type track circuit to the rail loop formed by the rails 2 and 3 within section T. Normaly this center fed track circuit will be supplied with energy, within the audio frequency range, by a transmitter F connected between rails 2 and 3 at approximately the center of the track section. A receiver unit is provided at each end of the track circuit, that is, receiver A at the entrance end and receiver B at the exit end. Each receiver unit is coupled to the rails at the paralleling connection, e.g., wire 7, by a pair of receiver coils, one placed adjacent each rail and connected in a series aiding network. Transmitter and receiver units for this type of track circuit are well known in the art and thus conventional blocks only are shown to represent these elements. When energy flows from the transmitter through the rails, as shown by the current arrows $i_F$, it is inductively received by each receiver unit and the corresponding supplemental track relay is energized. For example, supplemental track relay TRA, associated with receiver A, is normally energized by direct current energy supplied by receiver A when induced energy is received from the associated track coils. A corresponding track relay TRB is associated with receiver B at the exit end. It will be noted that this track circuit in the loop formed by rails 2 and 3 will not be affected by any normal train shunt and thus the receivers are normally energized and the corresponding relays picked up to close front contacts. Any broken rail in either rail 2 or 3 between the transmitter and a receiver results in the deenergization of that receiver and release of its relay. For example, if the broken rail occurs to the right of transmitter F so that receiver B is deenergized, relay TRB is likewise deenergized and releases. The supply of alternating current energy from terminals BX and NX to the local winding of the regular track relay TR is carried over front contacts *a*, in series, of relays TRA and TRB. Thus the release of either relay TRA or TRB, when a broken rail occurs, interrupts the regular track circuit operation by removing the energy from the local winding of relay TR. This provides an indication of an existing fault so that corrective measures may be taken. A check of the condition of the AF track circuit will result in the discovery of a broken rail condition. The AF track circuit of FIG. 4 may also be added to the arrangement of FIG. 3 if desired to provide additional broken rail detection for that arrangement.

Another embodiment of my invention includes a coupling between the rails 2 and 3 in the track circuit portion of the overall arrangement. Two forms of this embodiment are shown in FIGS. 5 and 6. In these arrangements, a center tapped impedance bond is used at each end of the track circuit connected directly between rails 1 and 2. The center tap is of course connected by lead 6 to the corresponding center tap of the bond in the adjoining track section. The center tap is also connected by a resistor $R_3$ to rail 3 to provide a circuit path from lead 6 for propulsion current $I_3$. A series L-C circuit comprised of inductor $X_L$ and capacitor $X_C$ is connected between rails 2 and 3 at each end of section T. The secondary or track winding of transformer TT is then connected between rail 1 and the intermediate or junction connection between inductor $X_L$ and capacitor $X_C$. The track winding of relay TR at the entrance end is similarly connected between rail 1 and a corresponding junction between the inductor and capacitor in the L-C circuit at that end. The L-C circuits coupling rails 2 and 3 provide the necessary phase shift between the currents from the track circuit and the local supply in the windings of relay TR to operate the relay when the track section is unoccupied. The preferred arrangement of this embodiment is shown in FIG. 6 with capacitor $X_C$ connected to rail 3 and inductor $X_L$ connected to rail 2. However, either form of the connections will provide the required and necessary operation of relay TR. It can be demonstrated mathematically that a train shunt of either gage will sufficiently vary the phase of the track circuit current that relay TR will assuredly release to detect train occupancy of section T. This arrangement also improves broken rail detection, for rails 2 and 3, by the track circuit.

The arrangements of my invention thus provide track circuits for dual gage railroads which also supply cab signal energy to trains of either gage traversing the stretch of track. The arrangement accommodates electric propulsion current in the rails with a minimum of interference between the propulsion return current and the track circuit currents. Several modifications of the basic arrangement allow circuits to be adapted to match the track characteristics to balance the propulsion current and the track circuit current phase shifts. Propulsion current balance eliminates interference with the cab signal reception on the train. Broken rail detection is also provided and may be easily improved as the track characteristics require. These arrangements provide, for an electrified, dual gage railroad, an efficient and effective track circuit operation that requires a minimum of apparatus to this maintain an economical and safe system.

Although I have herein shown and described but four embodiments of the dual track circuit with cab signals embodying the features of my invention, it is to be understood that various other modifications may be made therein within the scope of the appended claims without departing from the spirit and scope of my invention.

Having now described the invention what I claim as new and desire to secure by Letters Patent is:

1. A track circuit arrangement for a section of electrified, dual gage railroad, including a common rail and a first and a second other rail at different track gages from said common rail, said section being insulated in each rail from both adjoining sections, comprising in combination, a. a source of track circuit energy coupled at the exit; end of said section between said common rail and the other rails for supplying train detection energy, said first and second other rails being coupled to form a parallel circuit path between the ends of said section, b. a train detection means responsive to energy from said source and coupled at the entrance end of said section between said common rail and said other rails for detecting the occupancy of said section by a train of either gage, c. an impedance bond coupled between said common rail and said other rails at each end of said section and having one winding tap positioned to establish a preselected turn ratio between the two portions of the winding, and d. a connection between the winding tap of each impedance bond and the corresponding tap of an adjoining section bond for completing a return circuit for the propulsion current such that the reflux generated by the propulsion return current in each impedance bond on one side of said tap balances that developed on the other side of said tap.

2. A track circuit arrangement as defined in claim 1 in which, each train traversing said section is provided with cab signal apparatus coupled to the rails used by that train and responsive to the track circuit energy supplied by said source for providing cab signal indications on that train.

3. A track circuit arrangement as defined in claim 2 in which, a. said first and second other rails are coupled by a direct wire connection at least at each end of said section, b. each impedance bond winding is divided by said tap into two portions having a two to one ratio of turns with the portion having the larger number of turns connected to said common rail, and wherein c. the smaller winding portion of each bond carriers twice the current to said other rails as carried by the larger portion to develop an equal number of ampere-turns to balance the generated flux.

4. A track circuit arrangement as defined in claim 3 in which, a. said source supplies alternating current energy of a selected frequency different from the propulsion energy, and b. said train detection means is an alternating current, vane type relay having a track winding coupled between said common rail and said first other rail and a local winding connected to an extension of said source.

5. A track circuit arrangement as defined in claim 4 which further includes, a. a source of higher frequency energy connected between said first and second other rails in the vicinity of the midpoint of said section, b. a receiving means coupled to said first and second other rails at each end of said section and being selectively responsive to energy supplied through the rails by said higher frequency source, and c. each said receiving means being coupled for interrupting the supply of energy to the local winding of the associated track relay when no higher frequency energy is received to detect a broken rail in said other rails.

6. A track circuit arrangement as defined in claim 5 in which, a. said higher frequency source is an audio frequency transmitter connected for supplying audio frequency energy in both directions through said other rails, b. each receiving means comprises an audio frequency receiver coupled to the rails at the corresponding direct wire connection for responding to audio frequency energy from said transmitter and an auxiliary track relay energized by the associated receiver when audio frequency track energy is present, and c. each auxiliary track relay controlling said source extension for interrupting the supply of energy to the local winding of said track relay when that auxiliary relay is deenergized.

7. A track circuit arrangement as defined in claim 2 in which, a. said energy source and said train detection means are each coupled between said common rail and said first other rail, b. each impedance bond winding is divided by said tap into portions having a two to one turns ratio, the larger portion being connected to said common rail and the smaller portion being connected to the second other rail, and which further includes, c. a second winding on each impedance bond having an equal number of turns with the smaller portion of the main winding and being connected between said main winding tap and said first other rail for balancing the ampere turns developed on each side of the impedance bond tap by the propulsion return current.

8. A track circuit arrangement as defined in claim 7 in which, a. said source supplies alternating current energy of a selected frequency different from the propulsion energy, and b. said train detection means is an alternating current, vane type relay having a track winding coupled between said common rail and said first other rail and a local winding connected to an extension of said source.

9. A track circuit arrangement as defined in claim 2 in which, a. the coupling between said first and second other rails is a series inductance-capacitance circuit path at each end of said section, b. said source and said train detection means are each coupled between said common rail and the junction between the inductance and capacitance elements of the associated first and second other rail coupling, c. each impedance bond is connected between said common and said first other rails, and d. each impedance bond has a center tap directly connected to the center tap of the adjoining section impedance bond and to said second other rail by a selected impedance element.

10. A track circuit arrangement as defined in claim 9 in which, a. said source supplies alternating current energy of a selected frequency different than the propulsion energy, b. said train detection means is an alternating current, vane type relay having a track winding connected between said common rail and the junction between the associated inductance and capacitance elements coupling said first and second other rails and a local winding connected to an extension of said source, and c. said selected impedance element is a resistor.

11. A track circuit arrangement for detecting and supplying cab signal energy to trains traversing a stretch of electrified, dual gage railroad having a common rail for both gages and a first gage second other rail, one for each gage, said stretch also being divided by insulated joints into a plurality of track sections, comprising in combination, a. a circuit means coupling said first and second other rails in parallel at each end of each track section, b. a source of track circuit energy having characteristics distinctive from the propulsion energy and being coupled between said common rail and the parallel circuit of said other rails at the axis end of each section for supplying train detection and cab signal energy into the rails of the corresponding section, c. a train detection means coupled between said common rail and the parallel circuit of said other rails at the entrance end of each section and responsive to the track circuit energy for registering the non-occupied or occupied condition of the associated section as track energy is received or absent, d. a pair of impedance bonds at each junction point between adjoining sections, one connected between said common rail and the parallel circuit of said other rails on each side of the insulated joints separating the sections, each bond having a tap for dividing its winding into two portions with a preselected ratio of turns, and e. a propulsion current return circuit connected between taps on each pair of impedance bonds for providing a return circuit path for the propulsion current, f. said preselected turns ratio in each bond winding equally dividing the ampere-turns developed in the bond winding by the return propulsion currents flowing in each rail to balance the flux generated within that bond.

12. A track circuit arrangement as defined in claim 11 in which, a. each circuit means is a direct connection between said first and second other rails, b. said source and said train detection means are each coupled between said common rail and said first other rail, c. said impedance bonds are connected between said common rail and said first other rail, and d. said preselected turns ratio is two to one with the larger portion of each bond winding being connected to said common rail so that the equal propulsion currents in each rail develop an equal number of ampere-turns on each side of the said winding tap for balancing the generated flux.

13. A track circuit arrangement as defined in claim 12 in which, a. said source supplies to each track section alternating current energy of a selected frequency different than the propulsion energy, and b. each train detection means is an alternating current, vane type relay having a track winding coupled between said common and said first other rail and a local winding connected to an extension of said source.

14. A track circuit arrangement as defined in claim 11 in which, a. said preselected turns ratio is two to one with the larger portion of each bond winding being connected to said common rail and the shorter portion being connected to said second other rail, b. each impedance bond includes a second winding having an equal number of turns with said shorter portion of the main winding, c. said source and said train detection means are each coupled between said common rail and said first other rail at the corresponding end of section, and d. each circuit means comprises an associated second winding and the shorter portion of the main bond winding being connected in series between said first and second other rails at the corresponding section end, whereby the ampere-turns developed by the propulsion current in the larger portion of the main winding equals the combined ampere-turns developed in the shorter portion and the second winding to balance the flux generated in the impedance bond.

15. A track circuit arrangement as defined in claim 14 in which, a. said source supplies to each track section alternating current energy of a selected frequency different than the propulsion energy, and b. each train detection means in an alternating current, vane type relay having a track winding coupled between said common and said first other rail and a local winding connected to an extension of said source.

16. A track circuit arrangement as defined in claim 11 in which, a. each circuit means is an inductance-capacitance series circuit path connected between said first and said second other rails at the corresponding end of a section, b. said source and said train detection means are each coupled between said common rail and the junction terminal of the inductance and capacitive elements of the circuit means at the corresponding end, c. each impedance bond winding is connected between said common rail and said first other rail, and b. said preselected turns ratio is one to one with the center tap also coupled to said second other rail by a selected impedance element.

17. A track circuit arrangement as defined in claim 16 in which, a. said source supplies to each track section alternating current energy of a selected frequency different than the propulsion energy, b. each train detection means in an alternating current, vane type relay having a track windings connected between said common rail and the junction between the associated inductance and capacitance elements coupling said first and second other rails and a local winding connected to an extension of said source, and c. said selected impedance element is a resistor.

* * * * *

UNITED STATES PATENT AND TRADEMARK OFFICE

CERTIFICATE OF CORRECTION

PATENT NO. : 4,022,408

DATED : May 10, 1977

INVENTOR(S) : Crawford E. Staples

It is certified that error appears in the above-identified patent and that said Letters Patent are hereby corrected as shown below:

Column 9, line 49, "reflux" should be --flux--

Column 11, line 39, erase "gage" and insert --and--
line 48, "axis" should be --exit--

Column 12, line 19, erase "the"

Column 13, line 11, "b." should be --d.--

Column 14, line 7, "windings" should be --winding--

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*